United States Patent [19]

Heisler

[11] Patent Number: 4,599,782

[45] Date of Patent: Jul. 15, 1986

[54] METHOD OF MAKING A COMPOSITE CONTAINER

[75] Inventor: Jerome S. Heisler, Wilmington, Del.

[73] Assignee: Container Corporation of America, Chicago, Ill.

[21] Appl. No.: 667,375

[22] Filed: Dec. 13, 1984

[51] Int. Cl.[4] ..... B31Q 3/00; B31C 1/00

[52] U.S. Cl. ..... 29/428; 493/303; 156/149

[58] Field of Search ..... 29/428; 493/303, 315; 53/79; 156/149, 287, 188, DIG. 18; 220/71, 404, 4.5; 229/5.5, 67

[56] References Cited

U.S. PATENT DOCUMENTS 2,684,775 7/1954 Von Hofe ..... 156/DIG. 18

2,810,492 10/1957 Bergen et al. ..... 156/188

*Primary Examiner*—Mark Rosenbaum

*Assistant Examiner*—Irene Golabi

*Attorney, Agent, or Firm*—Richard W. Carpenter

[57] ABSTRACT

A method of making a composite container comprising a hollow, molded, plastic body and a liner formed of relatively thin, flexible sheet material, such as paperboard or plastic film, surrounding and reinforcing the body side wall.

1 Claim, 4 Drawing Figures

METHOD OF MAKING A COMPOSITE CONTAINER

BACKGROUND OF THE INVENTION

1. Field of the Invention

This invention relates generally to composite containers, and more particularly to a composite container which comprises a molded plastic body the side wall of which is reinforced by at least one layer of sheet material, such as paperboard or plastic film, around the outer surface thereof and secured with respect thereto.

2. Description of the Prior Art

A prior art search in the United States Patent and Trademark Office directed to the subject matter of this application discloses the following U.S. Pat. Nos. 2,511,481; 2,522,058; 2,620,963; 2,989,218; 2,456,483; 3,357,626; 3,445,049.

None of the prior art patents uncovered in the search discloses or suggests the winding of a layer of sheet material, such as paperboard or film, around a previously molded light weight hollow plastic container body.

SUMMARY OF THE INVENTION

An object of the invention is to provide a light-weight, relatively inexpensive, non-returnable, composite container formed of reinforced molded plastic.

A more specific object of the invention is the provision of a light weight composite container including a molded plastic body the side wall of which is reinforced by a paperboard or plastic film shell which has been wound around the body after the body has been formed by a molding operation.

These and other objects of the invention will be apparent from an examination of the following description and drawings.

It will be understood that, for purposes of clarity, certain elements may have been intentionally omitted from certain views where they are believed to be illustrated to better advantage in other views.

DESCRIPTION OF THE PREFERRED EMBODIMENT

Figure 1:
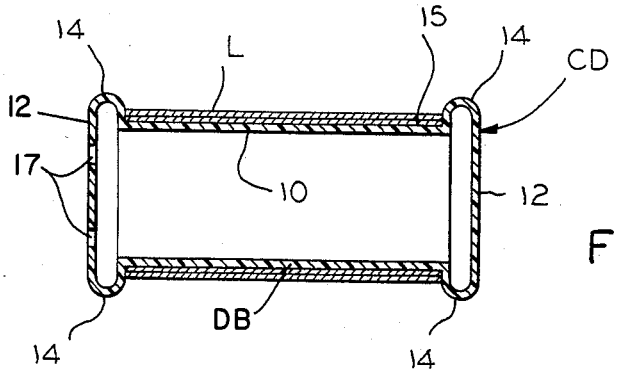
FIG. 1 is a fragmentary sectional view of a composite container embodying features of the invention.

Referring now to the drawings for a better understanding of the invention, it will be seen that the unique composite container, indicated generally at CD in FIG. 1, comprises a relatively light-weight molded plastic body, indicated generally at DB, the side wall of which is reinforced by a liner L formed of flexible sheet material such as paperboard or plastic, which has been wound around and secured to the outer surface of the body.

The container body DB includes a preferably cylindrical body side wall 10 and pair of integral end walls 12 which may be provided with annular flanges or chimes 14 which in turn form with the side wall 10 a cylindrical channel or recess 15 adapted to receive the liner in a manner hereinafter described. One of the end walls may be provided with the usual filling and dispensing openings 17.

As the plastic body may be molded by any conventional process on conventional equipment, the apparatus for producing it is not illustrated in this application.

Once the body has been formed, however, it may be mounted on a mechanism of the type illustrated in FIG. 2 in order to apply the outer shell in a manner hereinafter described.

Figure 2:
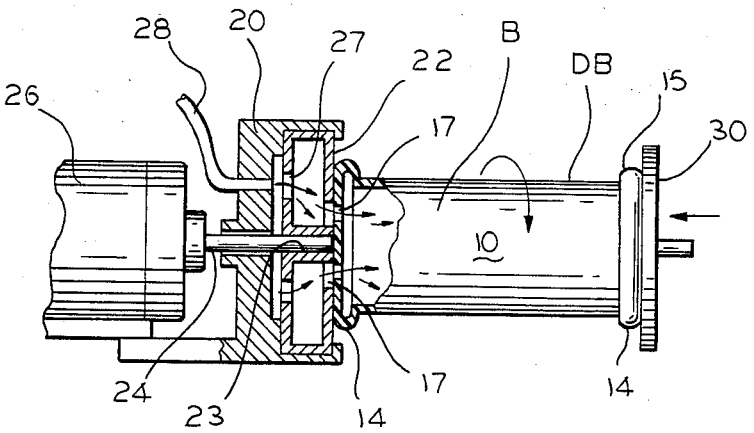
FIG. 2 is a fragmentary vertical sectional view illustrating the equipment used for holding a hollow molded body and rotating it in order to wrap a sheet of flexible material around the outer surface thereof.

The apparatus illustrated in FIG. 2 is by way of illustration, and it is not the only type of equipment on which the wrapping can take place. The equipment illustrated in FIG. 2 includes a frame indicated generally at 20 within which is housed a plenum or manifold 22 against which one end of the plastic body is placed. The manifold 22 includes a central bore 23 for receiving the shaft 24 of a motor 26 which serves to rotate the manifold and attached plastic body like a lathe rotates a workpiece.

The frame and manifold are provided with aligned openings 27 which are connected to an air line 28, in order to fill the container with air, so that it will not be collapsed when pressure is applied to the outer surface thereof. Thus, the plastic body can, in effect, function as a mandrel during the wrapping operation.

At the other end of the body there is a movable platen indicated generally at 30 which, when pushed against the plastic body, squeezes the body between the platen 30 and the manifold or plenum 22 to hold the body while it is being rotated.

Figure 3:
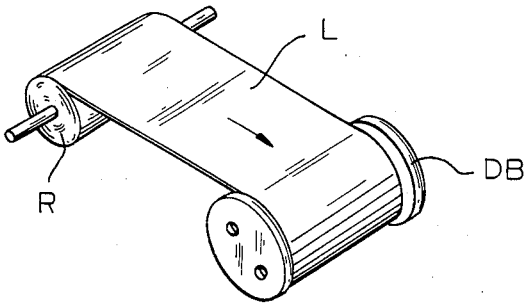
FIG. 3 is a fragmentary perspective view illustrating the manner in which a layer of sheet material is applied to the outer surface of a hollow molded container body.

As the plastic body is being rotated, sheet material is fed from a roll indicated generally at R in FIG. 3, and wrapped tightly around the body, preferably within the recess 15 between the flanges at opposite ends of the body. The sheet material may be adhesively secured to the side wall of the container as it is applied or it may be bonded or fused by heat sealing or other method of attachment.

Figure 4:
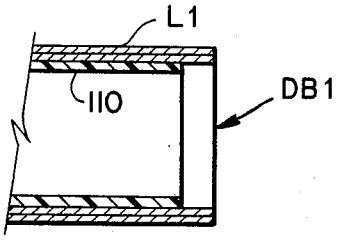
FIG. 4 is a fragmentary sectional view similar to FIG. 1, but illustrating a modified form of the invention.

Referring now to FIG. 4 of the drawings, a modified form of the invention is disclosed. In this embodiment the container body DB 1 shown is without chimes and the liner L 1 provided is longer than the container side wall 110, so the ends of the liner can be cuffed or crimped to an end closure, not shown, as desired.

The purpose of the wrapping is to provide a relatively inexpensive container by reinforcing a relatively thin side wall of a container body. The type of material used for the wrapping will depend upon the cost of raw materials at the time the container is manufactured and also the nature of the use for which the container is intended.

In either case there is provided a relatively strong, but yet inexpensive, composite container which may be used for many purposes.

What is claimed is:

1. A method of forming a composite container, comprising the steps of:

(a) molding from thermoplastic material a hollow body having a generally cylindrical side wall and a pair of end walls on opposite ends of the side walls;

(b) mounting said body on a structure which can hold said body to accommodate the introduction of air into said body and to accommodate the rotation of said body about its longitudinal axis;

(c) exerting pressure against said end walls of said body to prevent its movement in an axial direction while said body is being filled with air and being rotated about its axis;

(d) while the ends of said body are being subjected to pressure introducing into the interior of said body through one of said body ends air under sufficient pressure to prevent the collapse of said body when said body side wall is subjected to external pressure, whereby said body can serve as a mandrel;

(e) rotating said body about its longitudinal axis;

(f) while said body is being rotated, wrapping and securing around the outer surface of said body side wall at least one layer of flexible sheet material such as paperboard.

* * * * *